United States Patent [19]

Mahoney et al.

[11] 3,987,886

[45] Oct. 26, 1976

[54] MECHANISM FOR VARYING THE GAP BETWEEN THE PRINT HAMMERS AND THE TYPE FONT FACES OF A PRINTER

[75] Inventors: Frank A. Mahoney, Wyncote; Ronald W. F. Hutley, Lansdale, both of Pa.

[73] Assignee: Sperry Rand Corporation, New York, N.Y.

[22] Filed: Mar. 27, 1975

[21] Appl. No.: 562,702

[52] U.S. Cl. ..... 197/133 R; 197/149

[51] Int. Cl.[2] ..... B41J 15/00

[58] Field of Search ..... 197/126 R, 126 A, 126 B, 197/127 R, 133 R, 133 F, 138 R, 1 R, 149; 101/269, 93 R; 226/147, 168

[56] References Cited

UNITED STATES PATENTS

| | | | |
|---|---|---|---|
| 3,420,352 | 1/1969 | Moran et al. | 197/133 R |
| 3,515,063 | 6/1970 | Baker et al. | 101/269 |
| 3,750,792 | 8/1973 | Liles | 197/1 R |
| 3,776,341 | 12/1973 | Dobner et al. | 197/133 R X |
| 3,837,461 | 9/1974 | Waibel | 197/126 A |

FOREIGN PATENTS OR APPLICATIONS

| | | | |
|---|---|---|---|
| 1,224,696 | 3/1971 | United Kingdom | 101/93 |

*Primary Examiner*—Ralph T. Rader
*Attorney, Agent, or Firm*—William E. Cleaver

[57] ABSTRACT

The present arrangement provides a housing means in and upon which are mounted at least the paper advance tractor assemblies including the drive means therefor and the print hammers of the printer. In addition the housing means is formed to have an eccentric shaft pass therethrough which eccentric shaft is formed and disposed to move the housing means toward and away from the type font faces of the printer. The eccentric shaft is engaged in a gear relationship with a drive means that acts to rotate the eccentric shaft which actions imparts linear motion to the housing means assembly.

3 Claims, 2 Drawing Figures

Figure 1:
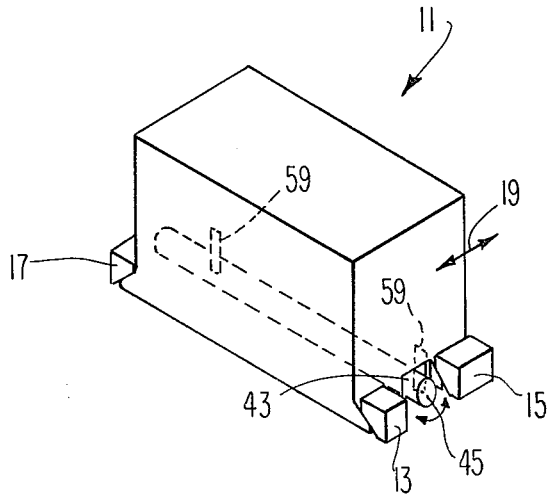

MECHANISM FOR VARYING THE GAP BETWEEN THE PRINT HAMMERS AND THE TYPE FONT FACES OF A PRINTER

BACKGROUND

It is well understood that in the use of printer devices of the kind that are commonly used to provide printout information for electronic data processing systems, it is necessary to employ different thicknesses of paper for the printout reports. For instance it is a common practice to provide a printout report which is made up of a plurality of carbon copies and therefore the total form package which is being passed through the printer, to have the report printed thereon, is composed of a number of sheets as well as the carbon paper, and this package actually becomes relatively thick. When such a thick package is used it is important to provide a gap which is sufficiently wide to enable the report, or the package of blank pages, to be transported without being jammed either between the type hammers and the ribbon or between the ribbon and the backup plate or platen. If we consider a system where the paper is pushed by the type hammers against the type font (which may be on either a drum or a movable band or the like) then it should be understood that the hammer stroke be as consistent for a package of forms, as for a single sheet, and that the forms be held close to the hammers whether the hammers are striking a single sheet or a package of sheets.

The necessity for adjusting the gap between the print hammers and the type font (for the moment not being concerned that the ribbon lies therebetween) has long been recognized and there have been many solutions offered to accommodate this need.

For instance in one prior art arrangement the print drum is moved away from the hammer assembly and stop lugs are positioned further into or further out of the housing means so that when the print drum is set back in its printing position it is literally held further away or held closer to the print hammers. In this particular prior art arrangement the individual setting of the lugs can be critical in that they cannot cause a skew in the type font device and further the scheme necessiates unlocking and lifting out of the entire printing mechanism. In another prior art device the print drum mechanism is made pivotable at one location and a cam member is disposed to pivot the frame so that the print drum is moved away from the actuating hammers.

The present device accomplishes the misson of making the gap between the type font faces and the print hammers variable and accomplishes that misson with simplicity and with less complex hardware than was heretofore employed.

SUMMARY

The present system provides for a housing means which serves as a member in which, or upon which, the print hammers and the paper advance tractors and the drive mechanisms therefore are mounted. Accordingly when the housing means is moved, the tractor means are moved and the print hammers are moved. The present system provides a channel in the housing means into which there is fitted an eccentric shaft. The slot in the housing is formed to be larger than would be necessary if the eccentric shaft were perfectly formed. Into the additional space there is placed a spring element which comes to rest against the eccentric shaft so that in the event the eccentric shaft is not perfectly formed the body against which it will push to effect a bidirectional movement will always be firmly fitting against the eccentric shaft. In addition the system employs a worm gear drive which is connected to a shaft that protrudes from the system so that the user need only turn a knob on the end of that shaft to effect the worm gear movement which in turn is imparted to the eccentric shaft to move the housing in one of two directions.

Figure 2:
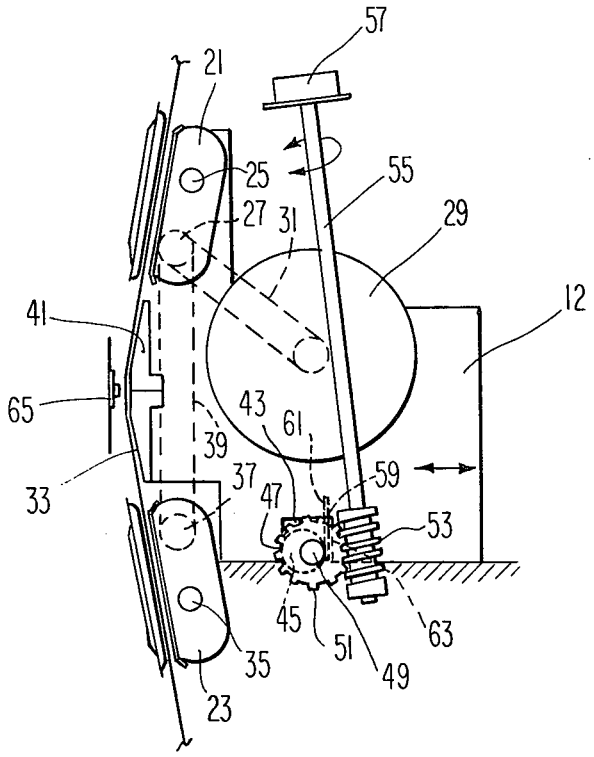

The objects and features of the present invention will be better understood in view of the following description taken in connection with the drawings wherein:

FIG. 1 is an overall view of the print head and paper feed assemblies represented as a box and FIG. 2 is a schematic layout of the eccentric shaft and the housing means which depict the present invention.

Consider FIG. 1 which shows a print head and paper feed assembly 11. Actually the print head and paper feed assembly is shown as an elongated rectangular block when in actuality the assembly would consist of two major castings one being the base upon which the second or upper one would be located. The second part of the major casting would be formed to hold the drive shafts and positioning shafts for the paper advancing tractor assembly. In addition it would be formed to hold the print hammer assembly as well as the logic circuits which actuate the print hammer assembly or possibly the cable harness coming from said logic circuits and would be further formed to hold the tractor drive motor. This upper casting can take many shapes and forms and the shape and form thereof is not a basic consideration to the present invention and therefore is only shown by way of overall illustration in both FIG. 1 and FIG. 2. With the understanding that the tractor assembly and the print hammer assembly are located in and on the print head and paper feed assembly 11 let us further examine FIG. 1.

It will be noted in FIG. 1 that there are three gibs shown. In particular gibs 13, 15 and 17. There is a fourth gib employed and it lies opposite gib 15 on the same side as gib 17. The gibs 13, 15 and 17, and one more that is not shown, serve to provide a tract in which the print head and paper feed assembly can be moved. It will be noted that the gibs 13, 15 and 17 are beveled at an angle and that there is a matching protrusion from the print head and paper feed assembly 11. The protrusions of the print head and paper feed assembly fit into the bevel portions of the gibs 13, 15 and 17 (and the one which is not shown) so that the print head and paper feed assembly 11 can move in accordance with the double headed arrow 19. It should be understood that the gibs 13, 15 and 17 (as well as the gib which is not shown) form the bottom part of the casting which was mentioned above.

Consider now FIG. 2 which shows a schematic layout of the upper part of the dual casting and in particular an end view of the print head and paper feed assembly. In FIG. 2 there is shown the righthandmost paper advancing tractor 21 of the upper pair of tractors. In addition in FIG. 2 there is shown the righthandmost tractor 23 of the lower pair of paper advancing tractors. The upper set of paper advancing tractors are similar to paper advancing tractors described in U.S. patent application Ser. No. 562,703 filed Mar. 27, 1975, now abandoned and assigned to the same assignee as the present application. As can be seen in FIG. 2, the paper advancing tractor 21 is mounted on a positioning shaft 25 as well as a drive shaft 27. The companion upper paper advancing tractor (companion of paper advance tractor 21) is also mounted on the positioning shaft 25 as well as the drive shaft 27. The positioning shaft 25, as described in U.S. patent application Ser. No. 562,703, mentioned above, enables the tractor 21 and its companion tractor to be moved laterally as well as being locked onto the shaft for a secure position while paper is advanced by the tractor. The drive shaft 27 is a shaft with grooves cut therein which grooves act as a gear means which fits into the gear means of a tractor assembly to drive that tractor. As can be determined by observation, the drive shaft 27 is coupled to a tractor drive motor 29 through the belt or chain 31. Accordingly when the drive motor 29 is operated, the drive shaft 27 is driven to move the tractor assembly 21 which acts to move the paper or webbing 33. If we study the makeup of the paper advancing tractor assembly 23 we find that it is mounted on a pair of shafts 35 and 37. The shaft 35 is a positioning shaft and serves the same purpose as did shaft 25 for the paper advancing tractor assembly 23 (as well as its companion tractor assembly) to enable this tractor assembly to be moved laterally and then locked into a secure position for a particular run of the webbing 33. In addition the paper advancing tractor assembly 23 is also mounted on a drive shaft 37. Drive shaft 37 is similar to the drive shaft 27, having grooves therein which serve to act as an elongated gear and which are fitted into the gear assembly in the paper advancing assembly 23 to drive that assembly. It will be noted that the drive shaft 37 is coupled to the drive shaft 27 through a belt or chain 39 so that when the drive shaft 27 is driven, as described earlier, the drive shaft 37 will also be driven. Accordingly it becomes apparent that the paper advancing tractor assemblies 21 and 23 operate simultaneously when they are driven by the tractor drive motor 29.

In FIG. 2 it can be seen that the webbing material 33 passes through the paper advancing tractor assembly 23 upward and across the print hammers as represented by the single print hammer 41 and on through the paper advancing tractor assembly 21. It has been found that if there is a minimum amout of space between the print hammer and the webbing material, i.e. the paper report, then the impact of webbing material on the font is sharp and accordingly there is a better "printing" of the letter or numeral than there would be if in fact there was a substantial air gap between the hammer and the paper or webbing 33. Accordingly it behooves the system to locate the print hammer as close to the paper as possible. It follows that if there is any adjustment to the system that the best adjustment would be an adjustment wherein the paper remains relatively close to the print hammer. While there is only a small ribbon section 42 shown, it should be understood that in a system there would be a ribbon located between the type font and the paper or webbing element so that when the hammer is actuated to strike the type font, it strikes the type font in conjunction with a ribbon so that there is a transfer of ink from the ribbon to the paper.

It will be noted in FIG. 2 that the print hammer and the paper advancing tractors 21 and 23 as well as the tractor drive motor are mounted on or in the housing casting 12. As mentioned earlier the shape of the housing casting 12 can be varied provided that such an element permits the print hammers and the paper advancing tractor assemblies, as well as the drive mechanism therefore, to be mounted in some connected fashion.

With respect to the present invention the casting 12 has a slot 43 cut therethrough as can be seen in both FIG. 1 and in FIG. 2. Located in the slot 43 is an eccentric bar 45 which can also be seen in both FIG. 1 and FIG. 2. The eccentric shaft 45 has its irregular cam portion shown abutting the wall 47 of slot 43. The eccentric shaft 45 has its axis portion 49 mounted in a drive gear 51. The drive gear 51 is fabricated so that it meshes with the worm gear 53. The worm gear 53 is coupled to a shaft 55 which in turn is coupled to a gap control knob 57. It should be further noted that in the slot 43 there is located a flexure spring member 59. The flexure spring member is secured into a slot 61 and is disposed so that when it protrudes from the slot 61 it rides continually in abutment, or comes in contact continually, with the eccentric shaft 45. There will be further noted that the slot 43 is formed to be larger than it would necessarily have to be in order to accommodate the eccentric shaft 45. However in this additional space the flexure spring is located and by employing the flexure spring rather than relying on the back wall 63, of the slot 45, the system assures that in the event that eccentric is not properly fabricated there will always be some "back wall" (i.e. flexure spring 59) which it will abut in order to drive the casting in one of two directions.

Now the present system operates in the following fashion. If the operator wants to widen the gap between the print hammer 41 and the type font 65 then the operator would turn the gap control knob 57 clockwise which in turn would drive the gear 51 clockwise which in turn drives the eccentric shaft 45 clockwise. The eccentric shaft 45 being driven clockwise abuts and pushes into the flexure spring 59 thereby forcing that spring toward the right. Since the flexure spring is secured in the groove 61 it will tend to force the casting 12 toward the right, hence the assembly moves to the right. Now it should be noted that when the assembly moves to the right the print hammer 41 as well as the paper advancing tractor assemblies 21 and 23 are all moved to the right. Hence the distance between the webbing or paper 33 and the print hammer 41 is not changed, while the gap between the webbing or the print hammer and the type font 65 is enlarged. On the other hand assuming that the eccentric 45 was in some position other than the one shown in FIG. 2 so that it could be advanced counterclockwise so as to push against the wall 47, then the operator would turn the gap control knob counterclockwise which would provide a rotational movement through the worm gear 53 to the gear 51 causing the gear 51 to rotate counterclockwise. The gear 51 would cause the eccentric 45 to rotate counterclockwise thereby pushing against the wall 47 and causing the casting 12 and therefore the entire assembly to move to the left. When the entire assembly is moved to the left, the gap between the webbing 33 and the type font 65 is narrowed.

The structure described above and the operation thereof is relatively simple to implement and provides the printing mechanism with the capacity for readily opening or closing the gap between the type font and the print hammers while at the same time maintaining the close position between the print hammers and the webbing material.

We claim:

1. A mechanism for varying the gap between the print hammers and the type font faces of a printer wherein said type font faces lie in a first plane when in a position to be engaged with said print hammers, comprising in combination: a movable base member having a horizontal dimension, a depth dimension, and a vertical dimension, said movable base member formed to have a slot disposed along its horizontal dimension and extending the length thereof, said slot having first and second wall means, said movable base member disposed in a second plane so that its horizontal dimension lies parallel to said first plane and its depth dimension lies perpendicular to said first plane; paper advancing tractor means disposed upon said base member to hold a paper record upon which printing is to be effected; print hammer means, having hammer faces, mounted on said base member to lie opposite the type font faces of a printer and disposed to have said hammer faces lie in a third plane which is parallel to said first plane and further disposed to have a gap formed between said print hammers and said type font; eccentric shaft means located in said slot, said eccentric shaft means formed to push said wall means of said slot in response to a rotation thereof whereby said movable base member is pushed in said second plane alternatively in first and second directions along its depth dimension direction thereby causing said gap between said print hammers and said type font faces to be varied in first and second directions while holding said first and third planes in parallel; and rotation means secured to said eccentric shaft means to effect a rotation thereof.

2. A mechanism for varying the gap between the print hammers and the type font faces of a printer according to claim 1 wherein said rotation means includes a gear member secured to said eccentric shaft and further includes a worm gear member rotatably engaged with said gear member whereby when said worm gear member is rotated said gear member is rotated to rotate said eccentric shaft and whereby there is further included a shaft means connected to said worm gear member and disposed to lie substantially in the direction of the vertical dimension of said base member whereby a movement of said worm gear can be effected at a distance substantially away from said base member.

3. A mechanism for varying the gap between the print hammers and the type font faces of a printer according to claim 1 wherein said slot is formed to be somewhat larger than said eccentric shaft and wherein said second wall means is a flexure spring located in said slot and disposed to come in contact with said eccentric shaft and to act as one wall of said slot so that forces applied to said flexure spring by the rotation of said eccentric shaft are applied to said base member to effect a movement thereof.

* * * * *